United States Patent [19]

Melnik

[11] Patent Number: 4,836,526

[45] Date of Patent: Jun. 6, 1989

[54] SHEET SORTERS

[75] Inventor: Peter Melnik, Rushden, England

[73] Assignee: Xerox Corporation, Stamford, Conn.

[21] Appl. No.: 102,177

[22] Filed: Sep. 29, 1987

[51] Int. Cl.[4] ..... B65H 31/00

[52] U.S. Cl. ..... 271/209; 271/212

[58] Field of Search ..... 271/209, 212, 296, 294, 271/293, 292

[56] References Cited

U.S. PATENT DOCUMENTS

| | | | |
|---|---|---|---|
| 3,957,264 | 5/1976 | Bach et al. | 271/287 |
| 3,988,018 | 10/1976 | Tusso et al. | 271/289 |
| 4,141,546 | 2/1979 | Queener | 271/296 X |
| 4,170,349 | 10/1979 | Baumann et al. | 271/296 |
| 4,290,596 | 9/1981 | Baumann | 271/296 X |
| 4,332,377 | 6/1982 | DuBois et al. | 271/293 |
| 4,353,542 | 10/1982 | Knight et al. | 271/212 X |
| 4,478,406 | 10/1984 | DuBois | 271/293 |

FOREIGN PATENT DOCUMENTS

| | | | |
|---|---|---|---|
| 0232369 | 11/1985 | Japan | 271/293 |
| 2059393 | 4/1981 | United Kingdom | 271/296 |

*Primary Examiner*—Joseph J. Rolla

*Attorney, Agent, or Firm*—William A. Henry, II

[57] ABSTRACT

A sheet sorter is disclosed which is designed to permit the sorting of sheets of significantly-greater area than the sorter bin support surface, without the projecting area of sheet bending over the bin edge and potentially interfering with the introduction of new sheets into adjacent bins. Each bin surface is provided with wings to induce a curve into a sheet being fed and stored in a bin, so as to give the sheet sufficient beam strength for the projecting portions to remain aligned with the portion of sheet which is in the bin.

8 Claims, 2 Drawing Sheets

SHEET SORTERS

This invention relates to sheet sorters, by which is meant a device for inserting a series of identical copy sheets, such as issue from a xerographic copier, into individual bins or like receptacles. The number of bins is always equal to or greater than the number of copies, and the sorting operating is repeated as many times as is necessary to complete each set of copies, so that each bin holds a complete set.

In order to reduce the volume of the sorter, it is desirable to make the area of each bin less than the area of the sheets, it is intended to house. One way of accommodating this is to arrange for each of the bins to be inclined at an acute angle to the vertical so that the 'excess' area of sheet projects beyond the respective bin. This then raises the problem of how to ensure that the projecting area of the sheet does not just flop over and interfere with sheets being fed into adjacent bins.

Various attempts at solving these problems have been made, for example, U.S. Pat. No. 3,957,264 is directed to the substantially horizontally stacking of sheet which have a tendency to curl in a collator bin having a small finite capacity. Vertically spaced and generally horizontally extending collator bins are provided with a concave configuration so that the curve in each collator bin is greater than the tendency of input sheets to curl. This construction facilitates the stacking of a large number of sheets into a compact space. In U.S. Pat. No. 3,988,018 an automatic paper sorter designed for use as an accessory to a copier machine is disclosed. Sorter bins have a concave configuration which takes advantage of paper curl developed in the copier to provide sufficient utilization of available bin space.

Commonly assigned copending applications, Attorney's Docket No. R/84006, U.S. Ser. No. 886,583 filed on July 16, 1986, entitled "Sheet Collector", and Attorney's Docket No. R/84011T U.S. Ser. No. 102,068, filed on Sept. 29, 1987, entitled "Sheet Collector", disclose a bottom-fed sheet collector that includes one or more upstanding sheet-receiving bins adapted to hold sheets in a substantially curved configuration transverse to the direction of sheet feed, and a bottom-fed sheet collector that includes at least one upright bin for receiving sheets with a guide means directing the sheets into the bin(s) and a scoop for lifting the trail edge of the sheets from the guide means into the bin(s), respectively.

Accordingly the present invention aims at providing a shape of bin which automatically curves each sheet as it is being fed in, so as to give the sheet sufficient beam strength for the projecting part of each sheet to be self-supporting.

The present invention therefore provides a sheet sorter which is as claimed in the appended claims.

The present invention will now be described by way of example with reference to the accompanying drawings, in which.

Figure 3:
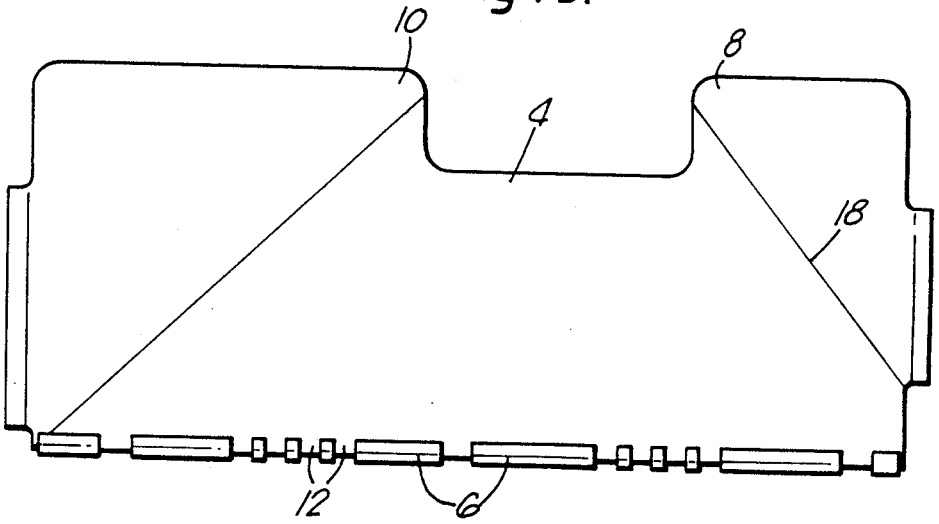
FIG. 3 is a front elevation of the tray acting as one surface of a bin.
Figure 4:
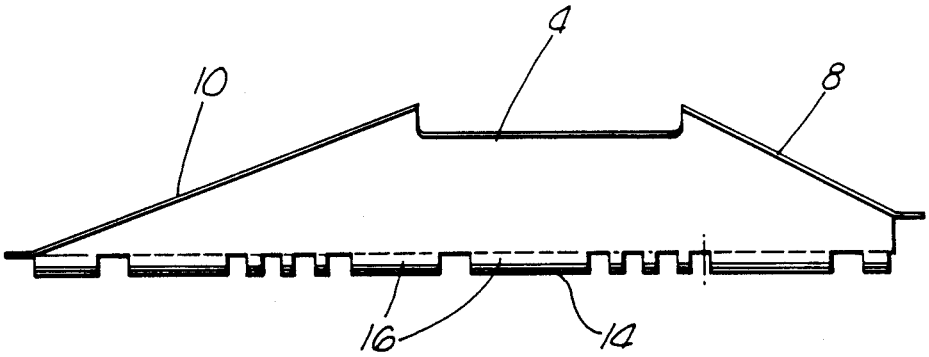
FIG. 4 is a plan view of the tray shown in FIG. 3, when in its position in the sorter.
Figure 5:
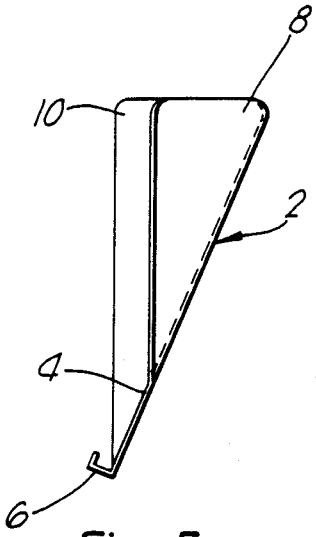
FIG. 5 is a side elevation of the tray shown in FIGS. 3 and 4.

The sorter of the present invention includes a horizontally-aligned series of individual trays 2, of which each has its major support surface 4 inclined at an acute angle to the vertical. At its bottom edge, each tray 2 is provided with a horizontal flange lip 6. As shown more clearly in FIG. 3, the tray is formed with two asymmetrical wings 8 and 10. Also as shown in FIG. 3, the flanged lip 6 can be interrupted with a series of 'cut-outs' 12, but these are not essential; both the flange 14 and the contiguous portion 16 of the lip could be continuous.

The lines 18 along which the wings 8 and 10 are folded lie at such an angle to the horizontal that the outer edges of the wings are vertical when the major surface 4 of the tray is at working angle to the vertical.

As shown more clearly in FIGS. 1 and 2, the horizontal spacing-apart between adjacent and parallel trays 2, in order to define the intermediate sheet-receiving bins 20 is such as to ensure that both wings 8 and 10 overlap the inclined wall of the opposing bin, for purposes which will be discussed below.

The sorter of this invention is intened to be of the bottom-fed type, in which aligned with the respective bin 20 is a pair of feed rolls 22 designed to expel a sheet 24 being fed into the interior of bin 20, along the direction indicated by arrow 26. The output for a xerographic or other copier is normally supplied along a horizontal output path (not shown) but at one end of which is a pair of feed rolls 28. These rolls grip each sheet being fed and pass it through a pair of curved guide surfaces 30 which act to deflect the sheet 24 from the horizontal path on which it enters feed rolls 28 to a path extending in parallel with the major axis of the bin 20.

Figure 1:
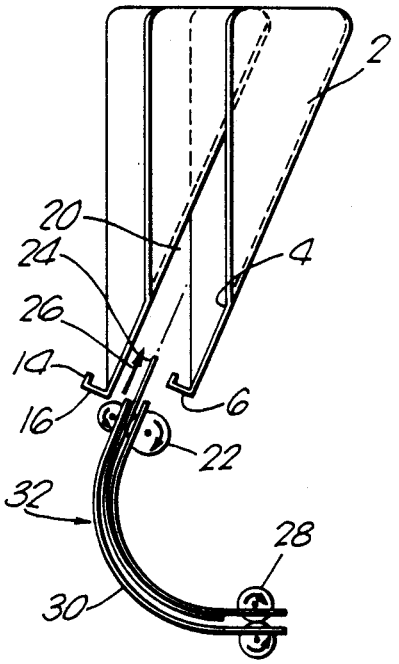
FIG. 1 is a diagrammatical side view of two adjacent bins in a sorter of the present invention.

By means which are now shown, after a sheet has been fed into the respective bin, either the sheet-feed device 32 shown in FIG. 1 is indexed along to the next bin, or the aligned series of trays is indexed relatively in the appropriate direction to the same effect. This process is repeated as many times as there are sheets to be sorted or bins to receive them.

In all the drawings, parts already referred to have retained their original references.

Figure 2:
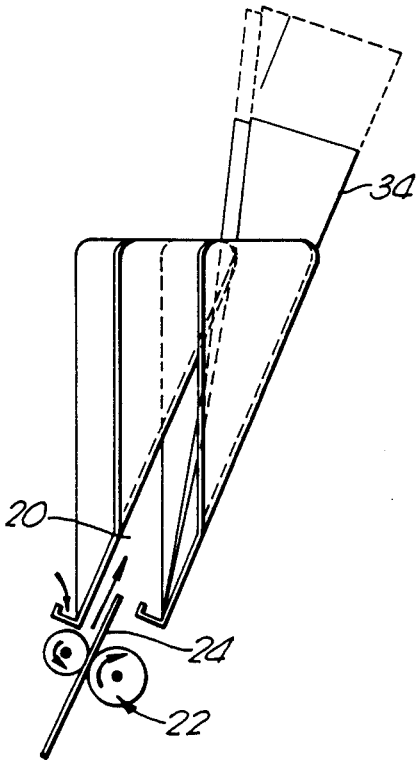
FIG. 2 is a view similar to FIG. 1, showing the extent to which different-sized copy sheets project beyond the top of the bin.

FIG. 2 illustrates the mode of operation of the present invention, from which Figure some parts have been omitted for clarity The sheet 24 being fed into bin 20 is originally planar. When its lead edge is spaced sufficiently from the feed rolls 22, the weight of the paper causes the lead edge to start to droop towards the tray 2. In so doing, one or both of its sides or corners with the lead edge come into contact with one or both of the wings 8 and 10. If the sheet being fed is of sufficiently-stiff material, it will resist assuming a more-curved shape across the width of the paper transverse to the feed direction 26 until after the lead edge has contacted the rear surface of the opposing tray. When this has happend, each sheet has the opposing tray pushing down on the center of the lead edge, and the side edges pushed upwardly by contact with the respective wings 8 and 10, so that a curvature is induced in the sheet which increases with distance from the trail edge. The speed with which each sheet is fed into the bin 20 is such that the sheet has its trail edge completely enter the bin 20 before the force of gravity stops the upward movement of the sheet and causes it to fall down so that its trail edge comes to rest on lip 6, which tends to cause each trail edge to remain straight, whereas the lead edge has by now assumed the shape of a relatively-uniform curve. It is this change of shape of the sheet with distance for the trail edge which imparts sufficient beam strength to the sheet for those portions 34 of each sheet which project beyond the upper ends of the trays 2 to be self-supporting. In practice, it has been found that a tray of which the height is only about 150 mm will support a sheet 425 mm in height. The relatively-small height of each bin thus renders the total volume of the sorter small, while permitting it to handle reliably the sorting of a wide range of sheet sizes, e.g., from B5 to B4 in a long-edge, first fed, orientation, and 425 mm and A3 in a short-edge, first-fed, orientation.

It will be appreciated from the above that the relatively-simple tray shape offer the significant advantages that the larger the sheets which are fed into the bins, then the greater is the amount of curvature induced, and therefore the necessary increased beam strength. In addition, for large sheets fed short-edge first, the amount of curvature increases with distance from the trail edge, which is itself directly supported so as to locate its position and ensure that the differentiallycurved sheet is not displaced by gravity from the bin by virtue of the fact that its center of gravity is above the top surface of the bin.

Thus it will be seen that the present invention provides a sheet sorter of the bottom-fed type, in which a series of trays of identical and simple design induce curvature in sheets being fed into the bin so formed that the portions of the fed sheets which project beyond the top of the bins are self-supporting.

What is claimed is:

1. In a sorting apparatus having a series of opposing bins with each having a support surface and wing portions of the support surface that are inclined with respect to the support surface, said opposing bins being in inclined at a an acute angle with respect to a vertical plane, the improvement wherein said series of opposing bins are positioned such that copy sheets fed by feed means between opposing bins and into a respective one of said series of opposing bins will have their side as well as lead edges a contact said wings such that a central portion of the lead edge of each copy sheet contacts the bottom surface of the opposing bin such that the bottom surface of the opposing bin push down on the center of the lead edge of each copy sheet while the side edges of the copy sheets are pushed upwardly by contact with the respective wings in order to induce curvature in the copy sheets to aid in increasing the beam strength of the copy sheets and thereby enhance the stacking of copy sheets of various lengths without having the ends of the copy sheets droop over the ends of said bins.

2. The sorting apparatus of claim 1, wherein said wings of the bin into which copy sheets are being stacked overlap a plane of the support surface of its opposing bin.

3. The sorting apparatus of claim 2, wherein each of said bins includes lip means which causes each released copy sheet to remain straight in said bins.

4. The sorting apparatus of claim 3, wherein said wings are of differing area in order to increase the beam strength of incoming copy sheets.

5. The sorting apparatus of claim 4, wherein said lip means includes a flange portion that extends parallel to said planer copy sheet support surface.

6. The sorting apparatus of claim 5, wherein said flange portion is an integral part of said lip means.

7. In a sorting apparatus having a series of opposing bins which are inclined at an acute angle with respect to a vertical plane, the improvement wherein each of said opposing bins includes a planar copy sheet support surface and wings extending upwardly at an acute angle with respect to said planar copy sheet support surface, and wherein said wings of the bin into which copy sheets are being stacked overlap the wings of its opposing bin by passing through the plane of the opposing planar copy sheet support surface, and wherein said series of bins are positioned such that copy sheets fed by feed means between opposing bins and into a respective one of said series of opposing bins will have their side as well as lead edges contact said wings such that a central portion of the lead edge of each copy sheet contacts the bottom surface of the opposing bin such that the bottom surface of the opposing bin pushes down on the center of the lead edge of each copy sheet while the side edges of the copy sheets are pushed upwardly by contact with the respective wings in order to induce curvature in the copy sheets to aid in increasing the beam strength of the copy sheets and thereby enhance the stacking of copy sheets of various lengths without having the ends of the copy sheets droop over the ends of said bins, and wherein each of said bins includes lip means which causes each released copy sheet to remain straight in said bins, said lip means having an integral flange portion that extends parallel to said planar copy sheet support surface.

8. The sorting apparatus of claim 7, wherein said wings are of differing area in order to increase the beam strength of incoming copy sheets.

* * * * *